US010125989B2

(12) United States Patent
Lefebvre et al.

(10) Patent No.: US 10,125,989 B2
(45) Date of Patent: Nov. 13, 2018

(54) SEALING ASSEMBLY TO FILL AND SEAL A RESERVOIR OR A DISPOSABLE GAS LIGHTER

(71) Applicant: SOCIETE BIC, Clichy (FR)

(72) Inventors: Guy Lefebvre, Redon (FR); Yann Lefebvre, Pornichet (FR)

(73) Assignee: BIC VIOLEX S.A., Anixi (GR)

( * ) Notice: Subject to any disclaimer, the term of this patent is extended or adjusted under 35 U.S.C. 154(b) by 470 days.

(21) Appl. No.: 14/768,466

(22) PCT Filed: Mar. 5, 2013

(86) PCT No.: PCT/IB2013/000534
§ 371 (c)(1),
(2) Date: Aug. 18, 2015

(87) PCT Pub. No.: WO2014/135911
PCT Pub. Date: Sep. 12, 2014

(65) Prior Publication Data
US 2015/0377486 A1 Dec. 31, 2015

(51) Int. Cl.
*F23Q 2/52* (2006.01)
*B65B 3/12* (2006.01)
(Continued)

(52) U.S. Cl.
CPC ..... *F23Q 2/52* (2013.01); *B65B 3/12* (2013.01); *B65B 7/2821* (2013.01);
(Continued)

(58) Field of Classification Search
None
See application file for complete search history.

(56) References Cited

U.S. PATENT DOCUMENTS 3,224,234 A 12/1965 Zellweger
3,253,430 A 5/1966 Piffath
(Continued)

FOREIGN PATENT DOCUMENTS

GB 1062654 3/1967
JP 49-073273 7/1974
(Continued)

OTHER PUBLICATIONS

International Report of PCT/IB2013/000534; dated Nov. 22, 2013.

*Primary Examiner* — Hemant M Desai
*Assistant Examiner* — Tanzim Imam
(74) *Attorney, Agent, or Firm* — Polsinelli PC

(57) ABSTRACT

A sealing assembly, for filling and sealing a reservoir of a gas lighter that includes a cylindrical well, a plug having a front section and a rear section, the front section having radial projections and at least one recess to provide a fluid passage, the rear section having a circular bulge/bump portion, and a weld portion adapted to be melted by welding, wherein the plug is adapted to be moved from a first position (P1) in which a gas passage is, to a second position (P2), temporary seal position, in which a gastight contact is provided between the circular bulge portion of the plug and an inner wall of the well, and further from the second position to a third axial position (P3), definitive seal position, wherein the weld portion of the plug is definitely welded to the reservoir in a gastight manner.

17 Claims, 3 Drawing Sheets

(51) Int. Cl.

| | |
|---|---|
| ***B65B 51/22*** | (2006.01) |
| ***B65B 7/28*** | (2006.01) |
| ***B65D 39/00*** | (2006.01) |
| ***B65D 53/06*** | (2006.01) |

(52) U.S. Cl.
CPC ..... *B65B 7/2842* (2013.01); *B65B 51/225* (2013.01); *B65D 39/0005* (2013.01); *B65D 53/06* (2013.01)

(56) References Cited

U.S. PATENT DOCUMENTS 3,494,817 A * 2/1970 Whitecar ..... B29C 65/08 156/567
3,632,083 A * 1/1972 Meeks ..... A61C 17/0202 251/282
3,841,517 A 10/1974 Lockwood
4,077,429 A * 3/1978 Kimball ..... F16K 24/00 137/588
4,173,858 A * 11/1979 Cassia ..... A47K 5/12 141/18
4,448,226 A * 5/1984 Dumont ..... F23Q 2/52 141/2
4,486,171 A 12/1984 Dumont
5,186,564 A * 2/1993 Fuhrmann, III ..... B43K 23/124 401/202
7,059,582 B2 * 6/2006 Adams ..... F16K 15/026 251/144
2005/0118547 A1 * 6/2005 Li ..... F23Q 2/42 431/254
2007/0207354 A1 * 9/2007 Curello ..... G05D 7/012 137/517
2014/0338630 A1 * 11/2014 Hodgson ..... F01N 3/2066 123/188.1

FOREIGN PATENT DOCUMENTS

JP S5270569 5/1977
JP H05157236 6/1993
JP H05157236 A * 6/1993
JP 5-180439 7/1993
JP 7-55142 3/1995
JP 6-4917 2/1997
WO WO 2007140048 12/2007
WO WO 2007140048 A2 * 12/2007 ..... F23Q 2/163

* cited by examiner

SEALING ASSEMBLY TO FILL AND SEAL A RESERVOIR OR A DISPOSABLE GAS LIGHTER

This application is a national stage application of International Application No. PCT/IB2013/000534, filed on Mar. 5, 2013, the entire contents of which are incorporated herein by reference.

FIELD OF INVENTION

The embodiments of the present invention relate to gas lighter, particularly a disposable gas lighter or gas reservoir for any type of lighter.

BACKGROUND OF THE INVENTION

More precisely, the embodiments of the present invention relates to a device and a method for facilitating the operations of filling and sealing of the lighter. More particularly the present invention relates to a disposable lighter or a gas reservoir for all types of lighter of the type which comprises a reservoir made of plastic material, especially amorphous plastic, adapted to be filled with a liquid hydrocarbon, especially butane or mixtures of butane and other hydrocarbons.

Synthetic amorphous materials, like polymers such as ABS (Acrylonitrile Butadiene Styrene) or polycarbonate, often used for disposable gas lighters, are advantageous since they allow users to see the level of remaining fuel within the reservoir. However, such amorphous materials may be brittle as a result of their non-crystalline structure.

It is known in the art to arrange a well in the bottom of the reservoir and to insert a ball into the well. However, the force-fit introduction of the ball within the well can cause cracks in the well of the reservoir and thus create a leakage.

Other methods rely on the use of an 0-ring seal; however the cost effectiveness of such solutions is poor with regard to a definitive sealing feature.

U.S. Pat. No. 4,486,171 describes a method using a plug member molded integrally with the lighter body. This plug allows the filling of the body but the final closing and sealing of the reservoir is provided by the dispensing valve. Since such valve is force-fitted into the well, the risk of causing cracks remains.

There is therefore a need to improve known solutions relating to the operations of filling and sealing a transparent disposable gas lighter.

SUMMARY OF THE EMBODIMENTS OF THE PRESENT INVENTION

To this end, it is provided a sealing assembly, enabling to fill and seal a reservoir of a disposable gas lighter, comprising

- a substantially cylindrical well provided in the reservoir body, having an inner wall,
- a plug, intended to be received in the well, having a front section and a rear section, the front section comprising radial projections and at least one recess to provide a fluid passage, the rear section having a circular bulge portion, and a weld portion adapted to be melted by welding, wherein the plug is adapted to be moved from a first axial position in which a passage is provided between an inner portion of the reservoir and outside, to a second axial position (P2) providing a temporary seal position in which a gastight contact is provided between the circular bulge portion of the plug and the inner wall of the well, and further from the second position to a third axial position (P3) providing a definitive seal position, wherein the weld portion of the plug is welded to the reservoir in a gastight manner.

Thanks to these dispositions, it is possible to obtain an inexpensive and reliable solution to seal the reservoir of a disposable gas lighter or a gas reservoir for any type of lighter.

Further, the operations of filling and sealing can be combined to provide an optimized industrial process.

In various embodiments of the present invention, one may possibly have recourse in addition to one and/or other of the following arrangements:

- the weld portion may be formed as a frusto-conical portion, intended to be melted against an edge portion of the well; whereby the welding operation is facilitated;
- the plug may be supplied as a separate part; whereby the respective materials of the well and the plug can be different and adapted to their respective feature or use;
- the front portion, the bulge portion and the weld portion are arranged axially next to one another; thereby providing a compact solution in the axial direction;
- the seal assembly is advantageously deprived of any intermediate part between the plug and the well, and deprived of any elastic member or biasing member; whereby the solution is particularly simple and the cost of the solution is especially low;
- the diameter of the bulge portion at rest is preferably between 101% and 105% of the inner diameter of the well; whereby the provisional sealing is ensured by a sufficient compression in the second position (P2);
- the lighter body and the well may be made of a non-crystalline resin comprising styrene acrylonitrile, ABS, or polycarbonate; which is an inexpensive transparent material; the welding can be an ultrasonic welding; which is a reliable industrial solution.
- the plug can be integrally molded with the reservoir; thereby decreasing the cost of parts supply.

The embodiments of the present invention also relates to a method to fill and seal a reservoir of a disposable gas lighter, wherein the reservoir has a substantially cylindrical well having an axis X and an inner wall, the method that includes:

/A/—providing a plug in the well, arranged in a first axial position, the plug having a front section and a rear section, the front section comprising at least one recess to provide a fluid passage, the rear section having at least a circular bulge portion and a weld portion adapted to be melted by welding, /B/—filling the reservoir with a supply of fuel, the fuel flowing into the reservoir through the fluid passage, /C/—pushing the plug into a second axial position wherein the circular bulge portion bears against the inner wall of the well thereby providing a provisional gastight contact, /D/—welding the plug into the well to result in a third axial position to form a definitive gastight seal.

In various embodiments of the method, one may possibly have recourse in addition to one and/or other of the following arrangements:

- the welding step /D/ may comprise the simultaneous actions of pushing and applying ultrasonic vibrations; which is a reliable industrial solution;
- steps /B/ and /C/ may be performed with the help of an injection nozzle having a movable center rod, such that the movement from first position to second position can be performed without removing the injection nozzle just after the filling operation; thereby providing an optimized solution in order to minimize the spill of the fuel supply.

BRIEF DESCRIPTION OF THE DRAWINGS

Other features and advantages of the invention appear from the following detailed description of one of its embodiments, given by way of non-limiting example, and with reference to the accompanying drawings, in which:

In the figures, the same references denote identical or similar elements.

FIGS. 1A and 1B show a bottom portion 12 of a gas lighter body 1. This gas lighter body 1 forms a gas reservoir and also houses various equipment at the top portion like dispensing valve, igniter, actuation means, known per se and not shown in the drawings here.

Figure 1A:
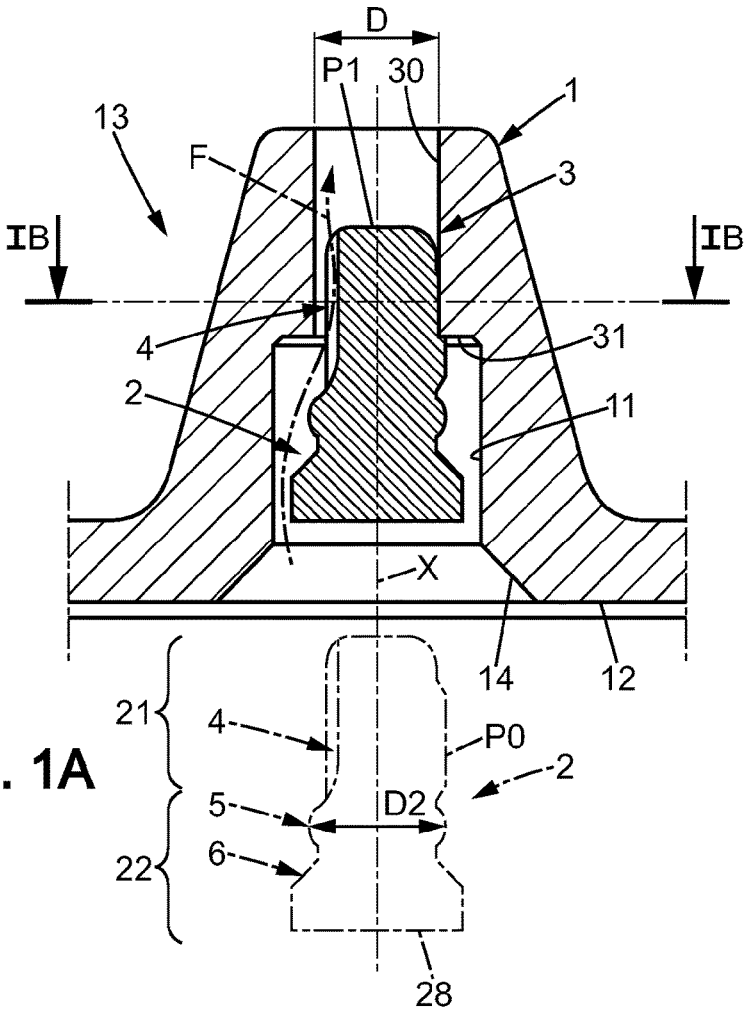
FIGS. 1A & 1B show respective axial and top sectional views of a sealing assembly according to an exemplary embodiment of the invention, the plug being in a first axial position.

In the bottom portion 12, there is provided a well 3. This well 3 extends along a longitudinal axis X, and exhibits a substantially cylindrical shape with an inner wall 30 and en edge portion 31; the latter being disposed in a recess 11 larger than the cylindrical well 3. The recess 11 may have various shapes, partly beveled or straight; in the illustrated example the recess comprises a beveled mouth 14 having a frusto-conical shape. Since the well is disposed within this recess 11, the well area stands back from the bottom surface of the bottom portion 12, which provides a natural mechanical protection.

The well area is molded integrally with the lighter body 1. The lighter body and therefore the well portion could be made of a non-crystalline resin, for example styrene acrylonitrile, ABS, or polycarbonate; this kind of material has the advantage of being transparent, so that it is possible to see the remaining level of liquid within the reservoir; further this kind of material is also inexpensive. The invention is not limited to transparent material, it can also be used with opaque non-crystalline materials or crystalline materials.

The well 3 provides a fluid communication between the interior space 13 of the reservoir and the exterior. After the fitment of at least the dispensing valve on the top of the lighter body, the well 3 is used to fill the reservoir with a liquid fuel comprising hydrocarbons, especially butane or mixtures of butane and other hydrocarbons. The diameter of the well can be small, for example comprised between 1 mm and 3 mm.

Figure 2A:
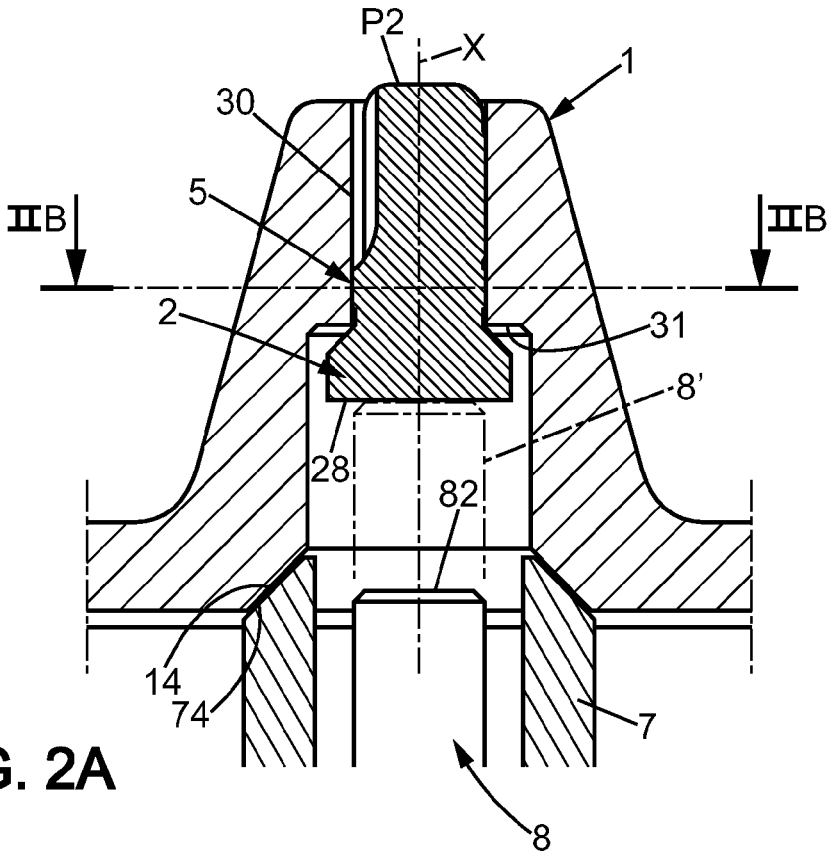
Figure 2B:
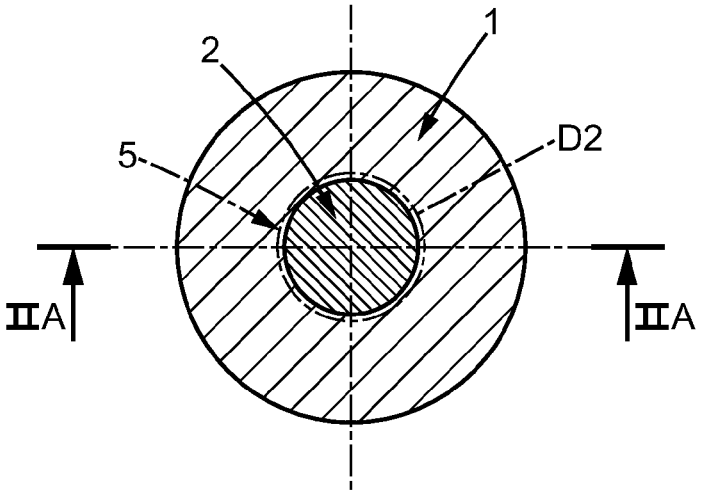

The fill operation is performed with the help of an injection nozzle 7 connected to a fuel external supply (not shown). The injection nozzle 7 has a beveled edge 74 complementary with the beveled mouth 14 in the bottom of the reservoir. In order to perform the fill operation, the injection nozzle 7 is brought to bear on the above mentioned beveled mouth 14 (as illustrated in FIG. 2A), so as to establish a close fluid communication between the fuel external supply and the interior space 13 of the reservoir 1. Thereafter, a valve is opened and a pressurized liquid fuel is injected into the reservoir 1.

Further, there is provided a plug 2 intended to be received in the well and intended to close the well 3 after the fill operation. More precisely, as shown on FIG. 1A, the plug extends along a longitudinal axis X with a substantial axisymmetric general shape and comprises a front section 21 and a rear section 22.

The material of the plug can be identical to the material of the reservoir; however it can also be a different type of resin or plastic material, not necessarily transparent, provided that the temperature melting point is not very different from the temperature melting point of the reservoir material, to favour a good welding capability as explained later.

One advantage to select an opaque material is to allow an optical automated check of the presence of the plug during the automated assembly process.

The plug material is not completely rigid, it exhibits a certain compressibility to allow deformation.

Figure 4:
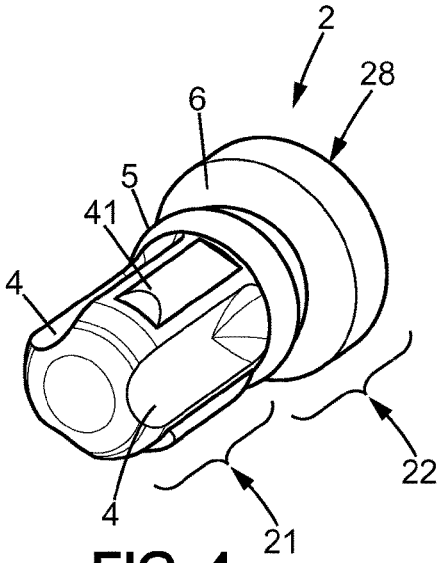
FIG. 4 shows a perspective view of an exemplary embodiment of a plug.

Referring also to FIG. 4, the front section 21 comprises radial projections 41 and at least one recess 4 to provide a fluid passage F between radial projections 41. The radial projections 41 are circumscribed in a circle having a diameter D1 slightly larger than the internal diameter D of the well. In the depicted example, there are provided three radial projections 41 delimited by three recesses 4.

The rear section 22 has a circular bulge portion 5 providing a circular bearing having a diameter D2 slightly larger than the internal diameter D of the well, and a weld portion 6 adapted to be melted by welding as it will be explained in details below. Further, it is provided an end portion 28 disposed transversely at the back of the rear portion 22.

Figure 1B:
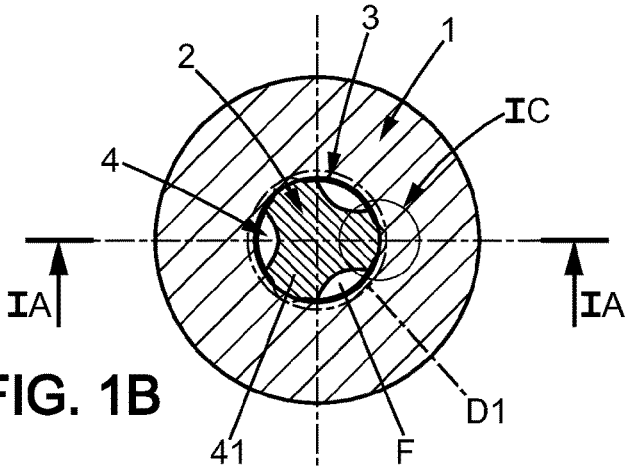
Figure 1C:
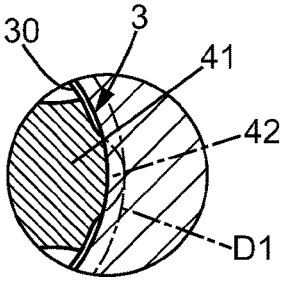
FIG. 1C shows an enlarged view of the sealing assembly corresponding to portion IC in FIG. 1B, FIGS. 2A & 2B show respective axial and top sectional views of the sealing assembly of FIG. 1, the plug being in a second axial position.

Before the insertion into the well, the plug 2 may be positioned in an axial preliminary position indicated by PO (dashed line in FIG. 1A). After which the plug 2 is pushed axially toward the well 3 up to a position named first axial position P1 (solidly delineated in FIG. 1A), wherein the radial projections 41 are slightly compressed in the radial direction, as illustrated in FIGS. 1B and 1C, where the compressed portions 42 generate a radial compression. Therefore, the plug 2 is firmly retained in this first position P1, in particularly to prevent any substantial axial movement of the plug during the filling operation during which the injection of liquid fuel exerts a pressure on the back portion 28.

In this first position P1, the well is not closed, indeed the recesses 4 arranged between radial projections 41 provide a fluid passage denoted F to allow the subsequent filling operation.

Thereafter, the above described injection nozzle 7 is applied to the beveled mouth 14, and liquid fuel is injected into the reservoir. When the prescribed quantity has been introduced in the reservoir, which can be determined by various means, a pushing rod 8 provided in the center of the injection nozzle 7 is moved upwards to move the plug 2 from the first position P1 to a second axial position denoted P2 (FIG. 2A) in which the bulge portion 5 is brought to bear against the inner wall 30 of the well 3. This second position P2 provides a temporary seal position for preventing the fuel to leak out of the reservoir. Thereafter, the injection nozzle can be removed.

It is to be noted that the movement of the front end 82 of the pushing rod 8 can be controlled by the force exerted or by displacement range. Thus, only the bulge portion is inserted in the well and not the weld portion 6 which abuts on the edge portion 31 of the well.

While the second position P2 provides a temporary seal position, there can be performed functional testing of the lighter if required, and/or the lighter can be moved to another assembly station.

More precisely, the diameter D2 of bulge portion 5 at rest can be chosen between 101% and 105% of the inner diameter D of the well. The radial compression stress of the bulge portion 5, added to the radial compression stress of the radial projections 41, provide a sufficient retention force against the action of the internal pressure prevailing in the reservoir after filling.

Figure 3A:
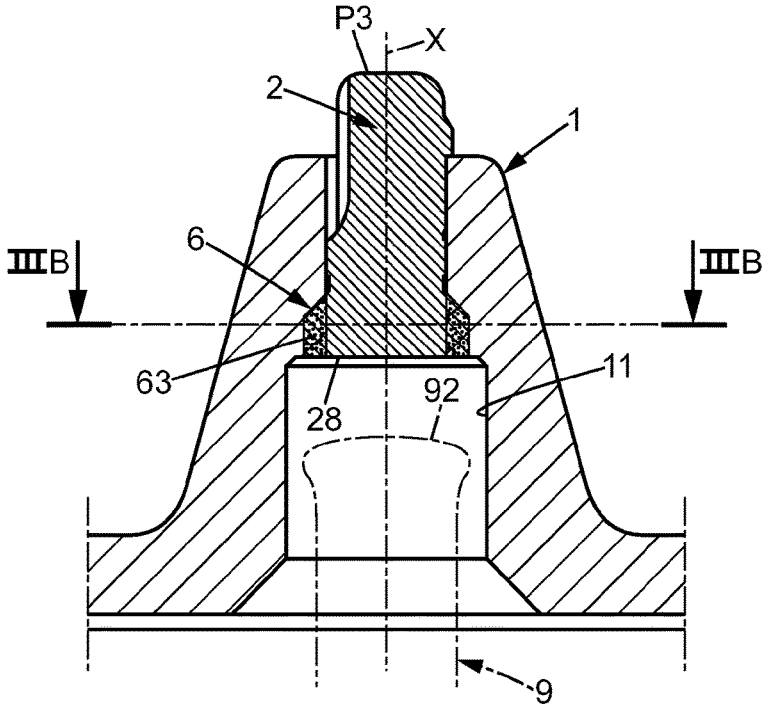
FIGS. 3A & 3B show respective axial and top sectional views of the sealing assembly of FIG. 1, the plug being in a third axial position.
Figure 3B:
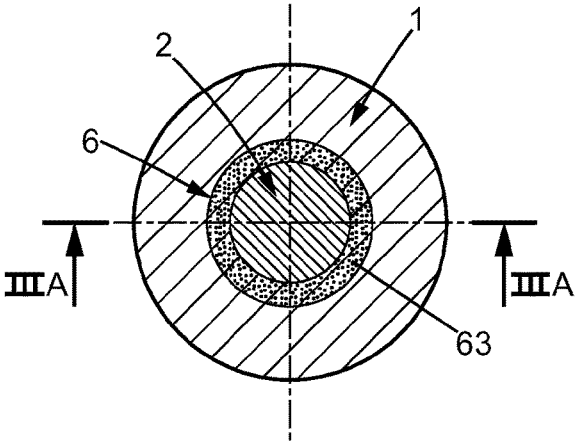

When the condition to definitively seal the reservoir is obtained, a definitive seal operation is undertaken. To this end, in the illustrated example, an ultrasonic sonotrode 9 with a front end 92 is applied to the back portion 28 of the plug 2. The ultrasonic sonotrode 9 simultaneously applies axial and transverse vibrations while pushing the plug 2 toward a third axial position P3 shown in FIG. 3A. A melted portion 63 ensures a definitive seal, thereby resulting in closing the reservoir in a gastight manner.

It is to be noted that other welding solutions are not excluded within the scope of the invention.

Although the plug 2 is supplied as a separate part in the illustrated preferred embodiment, it is also possible to have the plug integrally molded with the reservoir, the two parts possibly linked together by a breakable link.

Advantageously, the front portion 21, the bulge portion 5 and the weld portion 6 are arranged axially next to one another, to result in an axial overall dimension of the plug smaller than 10 mm, preferably smaller than 5 mm. This forms a compact solution which does not trespass much on the volume of the reservoir.

Advantageously, the seal assembly described above is deprived of any intermediate part between the plug and the well, and deprived of any elastic member or biasing member.

In other words, the method to use the seal assembly described above comprises at least:

/A/—providing the plug 2 in the well, arranged in a first axial position (P1, filling position), /B/—filling the reservoir with fuel flowing into the reservoir through the fluid passage 4, /C/—pushing the plug into a second axial position (P2 temporary seal position) wherein the circular bulge portion 5 bears against the inner wall of the well thereby providing a provisional gastight contact, /D/—welding the plug into the well 3 to result in a third axial position (P3, definitive seal position) to form a definitive gastight seal, preferably using an ultrasonic welding technique.

It should be noted that the bulge portion 5 can be dissymmetric and exhibit a shoulder shape. Further, the weld portion can be arranged in geometric continuity of the bulge portion. Moreover, the weld portion 6 can exhibit various forms not necessarily axisymmetric before welding.

It should be noted that the sealing assembly and methods described above can be used not only or a disposable gas lighter, but also for a reservoir of any kind of utility gas lighter.

The invention claimed is:

1. A sealing assembly, enabling to fill and seal a gas reservoir of a lighter, the sealing assembly comprising:

a reservoir body with a cylindrical well provided in the reservoir body, the cylindrical well having an inner wall, a plug, intended to be received in the cylindrical well, the plug having a front section and a rear section, the front section comprising radial projections and at least one recess to provide a fluid passage, the rear section having a circular bulge portion, and a weld portion adapted to be melted by welding, wherein the plug is adapted to be moved from a first axial position in which the at least one recess provides a filling passage between an inner portion of the gas reservoir and an outside of the gas reservoir, to a second axial position providing a temporary seal position in which a gastight contact is provided between the circular bulge portion of the plug and the inner wall of the cylindrical well, and further from the second axial position to a third axial position providing a definitive seal position in which the weld portion of the plug is joined in a gastight manner to an inner wall of the gas reservoir, and wherein, in the first axial position, the front section is in contact with an inner face of the cylindrical well.

2. The sealing assembly according to claim 1, wherein the weld portion is formed as a frusto-conical portion, intended to be melted against an edge portion of the cylindrical well.

3. The sealing assembly according to claim 1, wherein the plug is supplied as a separate part.

4. The sealing assembly according to claim 1, wherein the front section, the circular bulge portion and the weld portion are arranged axially next to one another, and wherein the radial projections of the front section are circumferentially spaced from each other, so as to form the at least one recess.

5. The sealing assembly according to claim 1, wherein the sealing assembly is deprived of any intermediate part between the plug and the cylindrical well, and deprived of any elastic member or biasing member.

6. The sealing assembly according to claim 1, wherein a diameter of the circular bulge portion at rest is between 101% and 105% of an inner diameter of the cylindrical well.

7. The sealing assembly according to claim 1, wherein the reservoir body and the cylindrical well are made of a non-crystalline resin comprising styrene acrylonitrile, ABS, or polycarbonate.

8. The sealing assembly according to claim 1, wherein the welding is an ultrasonic welding.

9. The sealing assembly according to claim 1, wherein the plug is integrally molded with the reservoir body.

10. The sealing assembly according to claim 1, wherein the plug is a one-piece plug.

11. The sealing assembly according to claim 1, wherein the reservoir body is made of an amorphous plastic, the plug being made of resin or plastic material.

12. The sealing assembly according to claim 11, wherein the circular bulge portion is axially spaced from the weld portion so as to be outside a meting area between the cylindrical well and the weld portion.

13. The sealing assembly according to claim 1, wherein the circular bulge portion is axially spaced from the weld portion so a to be outside a melting area between the cylindrical well and the weld portion.

14. The sealing assembly according to claim 1, wherein the circular bulge portion is configure to be in contact with a same cylindrical inner face of the cylindrical well in the second axial position and in the third axial position.

15. A method to fill and seal a reservoir of a disposable gas lighter, wherein the reservoir has a cylindrical well having an axis and an inner wall, the method comprising:

providing a plug in the cylindrical well, arranged in a first axial position, the plug having a front section and a rear section, the front section comprising at least one recess to provide a fluid passage, the rear section having at least a circular bulge portion and a weld portion adapted to be melted by welding, filling the reservoir with a supply of fuel when the front section of the plug is engaged with the inner wall of the cylindrical well and the plug is firmly retained in the first axial position, the the fuel flowing into the reservoir through the fluid passage, pushing the plug into a second axial position in which the circular bulge portion bears against the inner wall of the cylindrical well thereby providing a provisional gastight contact, and welding the plug into the cylindrical well to result in a third axial position of the plug to form a definitive gastight seal.

16. The method according to claim 15, comprising, in the welding step, simultaneous actions of pushing and applying ultrasonic vibrations.

17. The method according to claim 15, wherein the filling and pushing steps are performed with help of an injection nozzle having a movable center rod, such that movement of the plug from the first axial position to the second axial position can be performed without removing the injection nozzle from the reservoir after the filling step.

* * * * *